US005890303A

United States Patent [19]

Ishikawa et al.

[11] Patent Number: 5,890,303

[45] Date of Patent: Apr. 6, 1999

[54] HYDRAULIC BY-PASS CIRCUIT FOR A HYDRAULIC SHOVEL

[75] Inventors: Kouji Ishikawa, Tsuchiura; Toichi Hirata, Ushiku; Genroku Sugiyama, Ibariki; Tsukasa Toyooka, Ibariki; Youichi Kowatari, Ibariki, all of Japan

[73] Assignee: Hitachi Construction Machinery Co., Ltd., Tokyo, Japan

[21] Appl. No.: 774,703

[22] Filed: Dec. 26, 1996

[30] Foreign Application Priority Data

Dec. 27, 1995 [JP] Japan ..... 7-341474

[51] Int. Cl.[6] ..... E02F 5/02

[52] U.S. Cl. ..... 37/348; 60/421; 60/429

[58] Field of Search ..... 37/348, 382; 60/421, 60/422, 429, 430; 414/699, 694; 701/50

[56] References Cited

U.S. PATENT DOCUMENTS

| | | | |
|---|---|---|---|
| 4,286,692 | 9/1981 | Bauer et al. | 91/518 X |
| 4,508,013 | 4/1985 | Barbagli | 91/516 |
| 5,081,838 | 1/1992 | Miyaoka et al. | 37/348 X |
| 5,083,428 | 1/1992 | Kubomoto et al. | 60/429 X |
| 5,446,979 | 9/1995 | Sugiyama et al. | 37/348 |
| 5,481,872 | 1/1996 | Karakama et al. | 60/428 X |
| 5,673,558 | 10/1997 | Sugiyama et al. | 60/428 X |
| 5,692,377 | 12/1997 | Moriya et al. | 60/421 |
| 5,722,190 | 3/1998 | Arnold | 37/348 |

FOREIGN PATENT DOCUMENTS

| | | |
|---|---|---|
| 58-146632 | 9/1983 | Japan . |
| 60-4659 | 1/1985 | Japan . |
| 2-5447 | 1/1990 | Japan . |

*Primary Examiner*—Terry Lee Melius
*Assistant Examiner*—Victor Batson
*Attorney, Agent, or Firm*—Evenson, McKeown, Edwards & Lenahan P.L.L.C.

[57] ABSTRACT

A pilot pressure sensor detects a pilot pressure from an arm operating unit and outputs a pilot pressure signal. A drive signal corresponding to the pilot pressure signal is then outputted from a controller to a solenoid-operated proportional valve. Through the solenoid-operated proportional valve, a pilot pressure is fed to an auxiliary selector valve so that an opening of said auxiliary selector valve becomes greater. Of pressure oil delivered from a first hydraulic pump, a flow rate of the pressure oil to be branched to a side of a by-pass circuit is hence increased. The pressure oil fed through the by-pass circuit passes through a merging directional control valve and is caused to merge with pressure oil fed from a second hydraulic pump. The thus-merged pressure oil is then fed to a hydraulic arm cylinder.

5 Claims, 8 Drawing Sheets

HYDRAULIC BY-PASS CIRCUIT FOR A HYDRAULIC SHOVEL

BACKGROUND OF THE INVENTION

1.) Field of the Invention

This invention relates to a hydraulic circuit for a hydraulic shovel, and specifically to a hydraulic circuit for a hydraulic shovel, said hydraulic circuit having a plurality of hydraulic sources and being provided with a circuit for replenishing pressure oil from a predetermined one of the hydraulic sources to a predetermined actuator drive circuit when plural actuators are operated at the same time.

2.) Description of the Related Art

A hydraulic shovel carries working equipment for performing work such as excavation. This working equipment is composed of working members, such as a boom, arm and bucket, pivotally connected to corresponding pins and hydraulic actuators, such as hydraulic cylinders, for driving these working members, respectively. In actual work by the hydraulic shovel such as excavating, unloading or grading work, the working members such as the boom, arm and bucket are often operated simultaneously.

A hydraulic circuit for permitting smooth movements of working members, such as a boom, arm and bucket, in combination upon such simultaneous operation is disclosed, for example, in Japanese Patent Publication (Kokoku) No. HEI 2-16416.

The construction of an essential part of the hydraulic circuit according to this conventional art is illustrated in FIG. 8. The conventional art will hereinafter be described with reference to FIG. 8. As is depicted in the diagram, the hydraulic circuit according to this conventional art has a fist hydraulic pump 15, a second hydraulic pump 18, a directional control valve 16 for controlling a flow of pressure oil delivered from the first hydraulic pump 15, a hydraulic cylinder 14 for driving a boom 13, a directional control valve 19 for controlling a flow of pressure oil delivered from the second hydraulic pump 18, and a hydraulic cylinder 12 for driving an arm 11. On a downstream side of the directional control valve 16, a merging directional control valve 17 is arranged to guide the pressure oil from the first hydraulic pump 15 to the hydraulic arm cylinder 12. This merging directional control valve 17 is designed so that the pressure oil from the first hydraulic pump 15 is guided to the hydraulic arm cylinder 12 only when the hydraulic arm cylinder 12 is operated in an extending direction, namely, to move the arm 11 in a direction C (hereinafter referred to as the "arm-crowding direction"). Further, a by-pass circuit 41 is arranged to by-pass the pressure oil from an upstream side of the directional control valve 16 to a pressure oil feeding side of the merging directional control valve 17 via a restrictor 40. The directional control valve 16 is fed with a pilot pressure from a boom operating unit 21 and the directional control valve 19 and the merging directional control valve 17 are each fed with a pilot pressure from an arm operating unit 22, whereby the spool positions of the individual directional control valves are controlled.

According to the conventional hydraulic circuit constructed as described above, a spool of the directional control valve 16 is moved corresponding to a quantity of operation (which may hereinafter be called a "stroke") of the boom operating unit 21 so that the pressure oil from the first hydraulic pump 15 is fed to the hydraulic boom cylinder 14. When the arm operating unit 22 is operated, on the other hand, a spool of the directional control valve 19 and that of the merging directional control valve 17 are both moved corresponding to a stroke of the arm operating unit 22. When operated in the arm-crowding direction, the hydraulic arm cylinder 12 is also fed with the pressure oil from the first hydraulic pump 15 in addition to the pressure oil fed from the second hydraulic pump 18. Namely, when the boom operating unit 21 is not operated, the pressure oil from the first hydraulic pump 15 is guided to the merging directional control valve 17 through a center by-pass line 42 of the directional control valve 16. When the directional control valve 16 is operated, on the other hand, a portion of the pressure oil fed from the first hydraulic pump 15 is guided to the merging directional control valve 17 through the by-pass circuit 41 by way of the restrictor 40.

Accordingly, even upon combined operation of the boom 13 and the arm 11, especially upon operating the arm 11 in the crowding direction, the portion of the pressure oil fed from the first hydraulic pump 15 is guided, in addition to the pressure oil fed from the second hydraulic pump 18, to the hydraulic arm cylinder 12 so that the moving speed of the arm 11 can be increased.

Further, owing to the arrangement of the restrictor 40 in the by-pass circuit 41, it is possible to prevent the pressure oil from excessively flowing to a side of the hydraulic arm cylinder 12 from the first hydraulic pump 15. This makes it possible to prevent the moving speed of the boom 13 from being lowered.

As has been described above, the conventional art can improve the moving speed of the arm 11 without extremely lowering the moving speed of the boom 13 upon combined operation of the boom 13 and the arm 11. In the case of a hydraulic shovel, a higher arm-crowding speed generally leads to improvements in the operability and working efficiency upon excavation. The hydraulic circuit according to this conventional art is therefore an effective hydraulic circuit for a hydraulic shovel.

Incidentally, in excavating work by the hydraulic shovel, the boom 13 is often operated up or down while causing the arm 11 and a bucket 20 to pivot toward an unillustrated main body of the hydraulic shovel. At this time, a quantity of operation of the boom 13 is generally smaller than quantities of operation of the arm 11 and the bucket 20. In such excavating work, a flow rate of the pressure oil required for the hydraulic boom cylinder 14 becomes lower than that required for the hydraulic arm cylinder 12. Conversely, it is necessary to feed the pressure oil at an increased flow rate to the hydraulic arm cylinder 12, because the arm 11 is required to move faster and large excavational reaction force, hence, high load is exerted on the arm 11.

Upon performing such work, the above-described conventional art is unable to feed the pressure oil at a higher rate toward the hydraulic arm cylinder 12 because the restrictor 40 is arranged with its opening fixed. As a consequence, it is impossible to increase the speed of the arm 11. There is accordingly further room for improvements in the operability and working efficiency upon excavation.

In such excavating work, the quantity of operation of the boom 11 is small as described above. Large restriction resistance is therefore produced at the directional control valve 16 so that the pressure oil retained on an upstream side of the restrictor 40 is discharged into a tank through an unillustrated relieve valve. The conventional art is hence accompanied by a problem that an energy loss is large and the fuel consumption is deteriorated.

SUMMARY OF THE INVENTION

With the above-described problems of the conventional art in view, the present invention has as an object thereof the provision of a hydraulic circuit for a hydraulic shovel, which can increase the moving speed of an arm while reducing wasteful consumption of fuel even during combined operation of a boom and the arm in which, as in excavating work, the boom does not require much pressure oil and a relatively large load is applied to the arm.

To achieve the above-described object, the present invention provides a hydraulic circuit for a hydraulic shovel, said circuit being provided with at least a first hydraulic pressure source and a second hydraulic pressure source, a first directional control valve for controlling a flow of pressure oil delivered from the first hydraulic pressure source, a first hydraulic actuator operable by the pressure oil fed thereto via the first directional control valve, first operating means for designating operation of the first directional control valve, a second directional control valve for controlling a flow of pressure oil delivered from the second hydraulic pressure source, a merging directional control valve arranged on a downstream side of the first directional control valve for causing the pressure oil fed from the first hydraulic pressure source and the pressure oil fed from the second hydraulic pressure source through the second directional control valve to merge with each other, a second hydraulic actuator operable by the thus-merged pressure oil, and second operating means for designating operation of the second directional control valve and operation of the merging directional control valve, characterized in that the circuit further comprises: a by-pass circuit connecting an upstream side of the first directional control valve and an oil-feeding side of the merging directional control valve with each other; and an auxiliary selector valve arranged in the by-pass circuit for being operated by a signal from the second operating means.

Since the hydraulic circuit for the hydraulic shovel, which pertains to the present invention, is constructed as described above, operation of the first operating means causes the first directional control valve to open corresponding to a stroke of the first operating means, and the pressure oil delivered from the first hydraulic source is guided to the first hydraulic actuator via the first directional control valve. When the second operating means is operated, the second directional control valve and the merging directional control valve are operated corresponding to the quantity of the operation of the second operating means, and the auxiliary selector valve arranged in the by-pass circuit is also operated so that its opening changes. The pressure oil fed from the second hydraulic source through the second directional control valve and that fed from the first hydraulic source through the by-pass circuit by way of the auxiliary selector valve merge with each other, and the thus-merged pressure oil is fed to the second hydraulic actuator. At this time, the opening of the auxiliary selector valve varies depending on the quantity of operation of the second operating means. When the quantity of operation is increased to make the speed of the second hydraulic actuator faster, the opening therefore becomes greater, the restriction resistance at the auxiliary selector valve is reduced, and the pressure oil flows at a higher flow rate from the first hydraulic source into the by-pass circuit.

Accordingly, no high flow rate is required for the pressure oil on the side of the first hydraulic actuator. Even when the load on the side of the second hydraulic actuator is relatively high, the pressure oil can be fed at a high flow rate to the side of the second actuator by increasing the quantity of operation of the second operating means. As a consequence, the operability upon combined operation of the first hydraulic actuator and the second hydraulic actuator is not impaired, and the working efficiency is not reduced. When the quantity of operation by the second operating means is large, the restriction resistance at the auxiliary selector valve is reduced so that a large portion of the pressure oil delivered from the first hydraulic source can be fed to the side of the hydraulic actuator. This makes it possible to reduce an energy loss and hence wasteful consumption of fuel.

The hydraulic circuit may further comprise mode change means connected to the control means, and a plurality of data maps of operated quantities of said second operating means versus actuated quantities of said auxiliary selector means, said data maps corresponding to a like plural number of modes, respectively, are stored in the storage means. The mode change means makes it possible to choose desired characteristics for the target opening area of the auxiliary selector means depending on the load acting on the first hydraulic actuator, so that drive pressure required for the first hydraulic actuator can be assured.

BRIEF DESCRIPTION OF THE DRAWINGS

The above and other objects, features and advantages of the present invention will become apparent from the following description and the appended claims, taken in conjunction with the accompanying drawings, in which:

DESCRIPTION OF THE PREFERRED EMBODIMENTS

Figure 1:
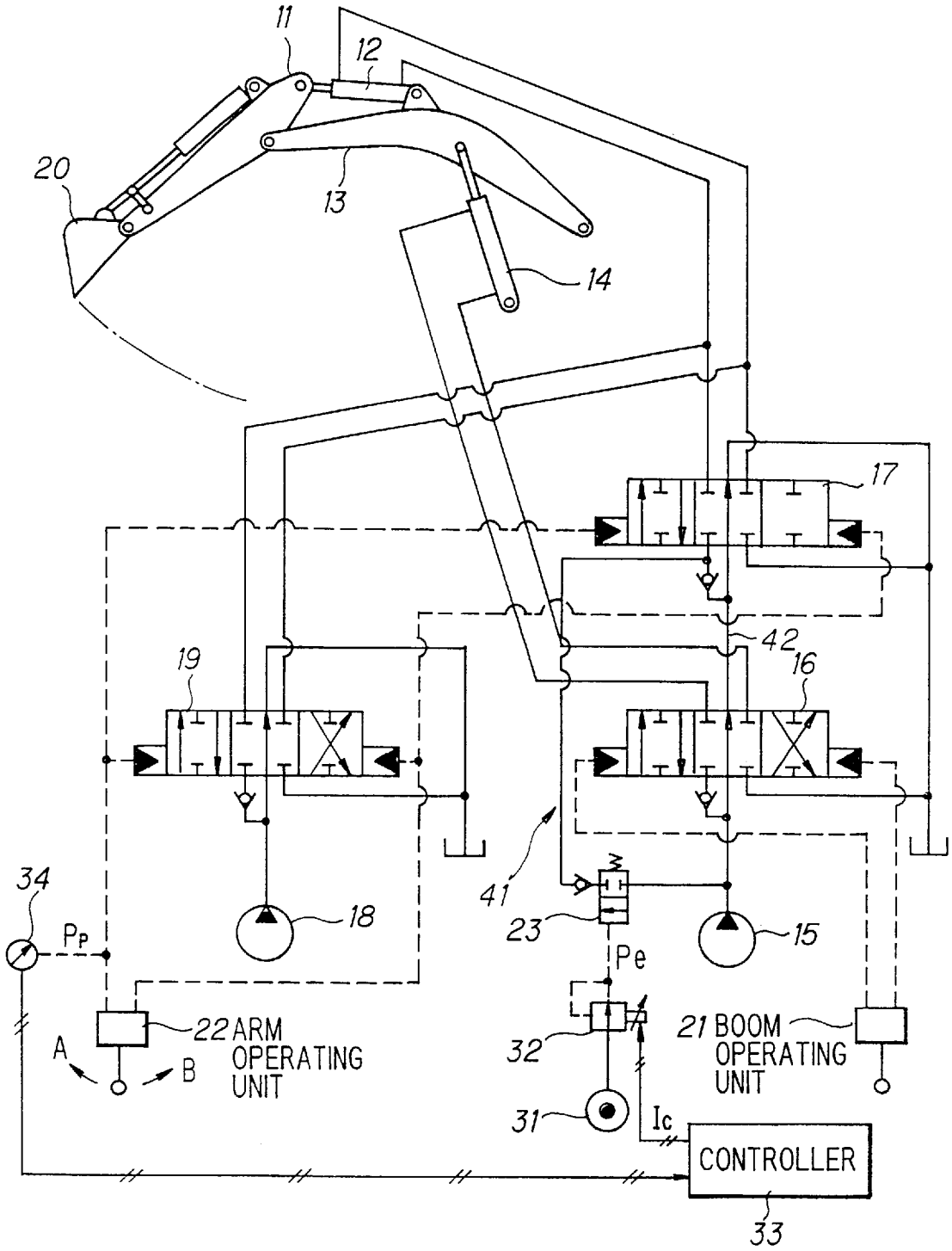
FIG. 1 is a diagram of a hydraulic circuit for a hydraulic shovel, according to a first embodiment of the present invention.

The preferred embodiments of the present invention will hereinafter be described with reference to the drawings.

Referring first to FIG. 1 through FIG. 4C, the hydraulic circuit for the hydraulic shovel, which pertains to the first embodiment of the present invention, will be described. In FIG. 1 through FIG. 4C, elements which are the same as the corresponding ones in FIG. 8, which shows the above-described conventional hydraulic circuit for the hydraulic shovel, are identified by the same reference numerals, and their description is omitted herein.

Figure 8:
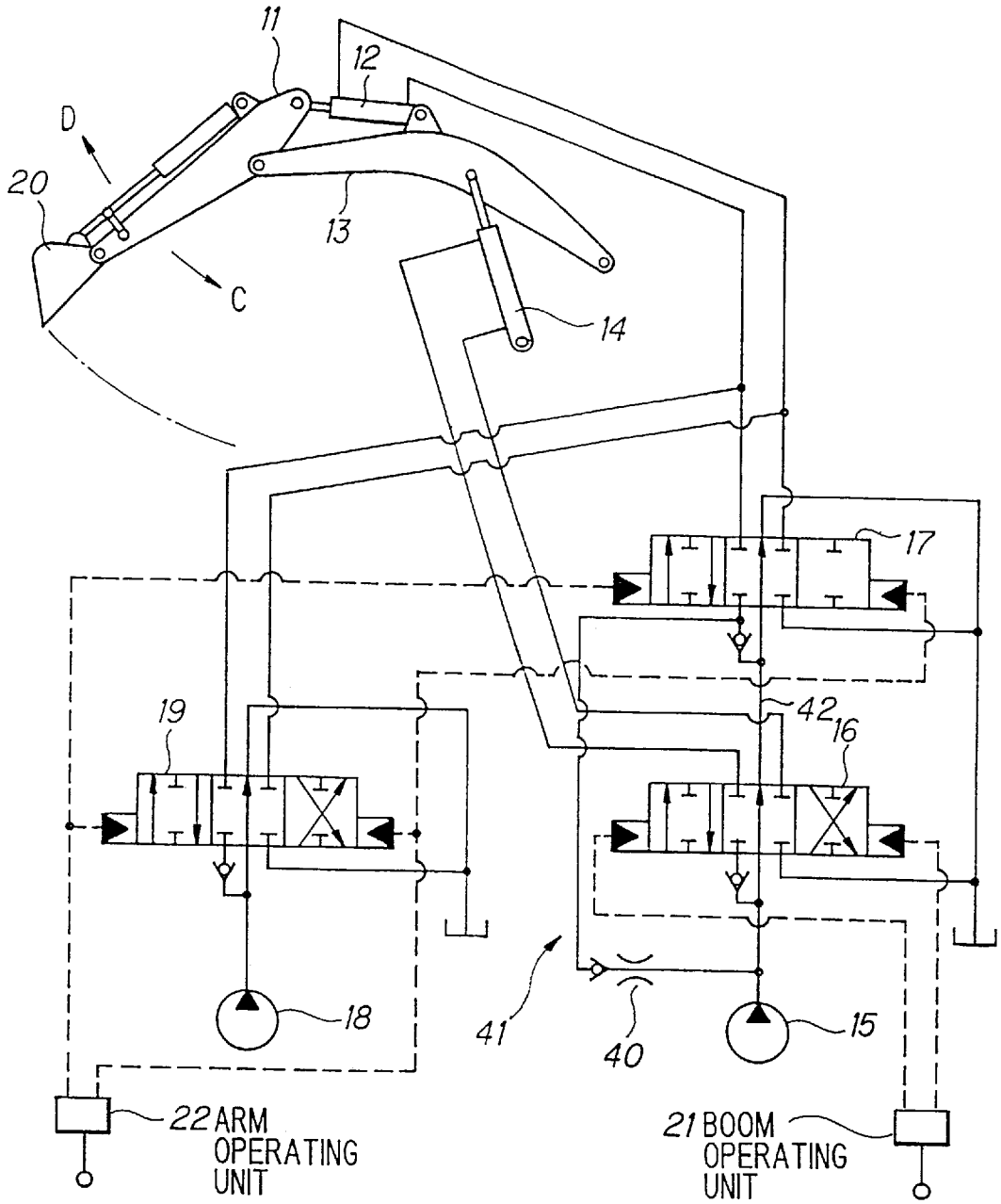
FIG. 8 PRIOR ART
FIG. 8 is a diagram of a conventional hydraulic circuit for a hydraulic shovel.

The hydraulic circuit, which is employed in the first embodiment and is shown in FIG. 1, and the conventional hydraulic circuit depicted in FIG. 8 are different in construction to each other as will be described next. Namely, as is shown in FIG. 1, the hydraulic circuit according to the first embodiment is provided with an auxiliary selector valve 23 operable by a pilot pressure, said auxiliary selector valve 23 being arranged in a by-pass circuit 41, a solenoid-operated proportional valve 32 for feeding a pilot pressure to the auxiliary selector valve 23, a pilot pressure sensor 34 for detecting a pilot pressure on an arm-crowding side of an arm operating unit 22, and a controller 33 for being inputted with a signal from a pilot pressure sensor 34 and outputting to the solenoid-operated proportional valve 32 a current corresponding to the signal. A pilot pressure to an auxiliary selector valve 23 is fed from a pilot pump 31.

In the first embodiment, a first hydraulic pump 15 corresponds to the first hydraulic source, a directional control valve 16 to the first directional control valve, a boom operating unit 21 to the first operating means, a second hydraulic pump 18 to the second hydraulic source, a directional control valve 19 to the second directional control valve, and the arm operating unit 22 to the second operating unit.

In the first embodiment constructed as described above, a pilot pressure Pp on an arm-crowding side becomes higher when the arm operating unit 22 is operated in a direction A, namely, in an arm-crowding direction. This pilot pressure Pp is detected by the pilot pressure sensor 34 and a pressure signal is inputted to the controller 33.

Figure 3:
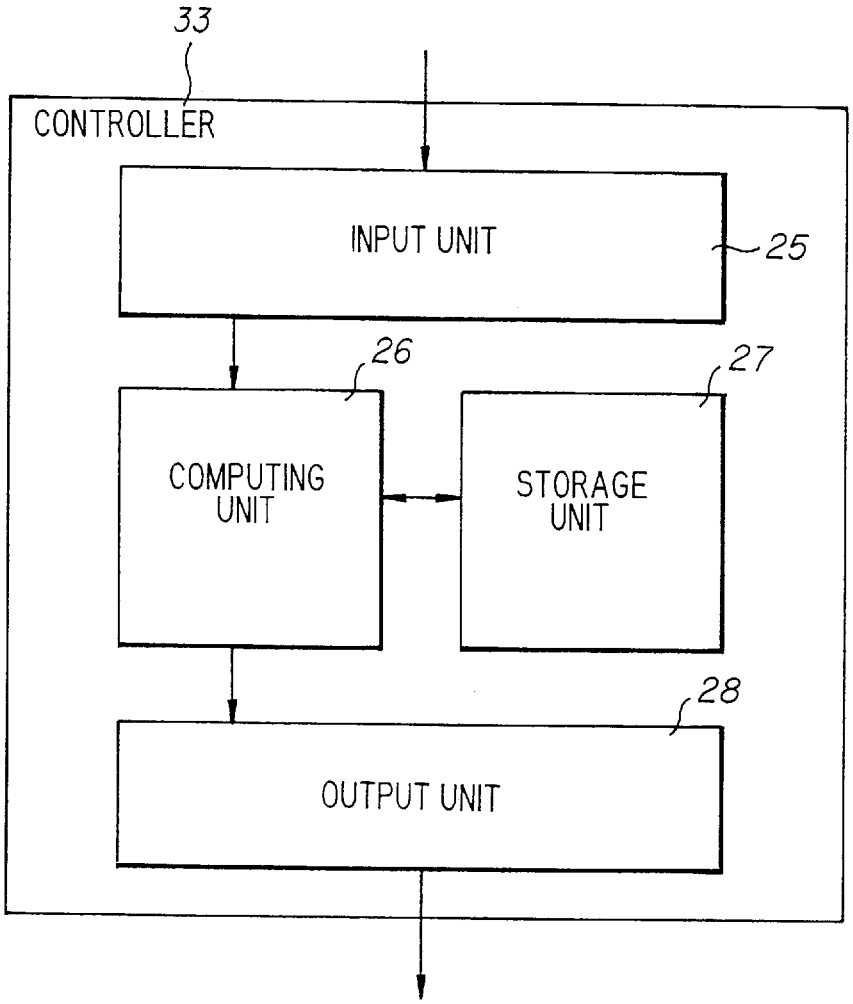
FIG. 3 is a block diagram showing the internal construction of a controller depicted in FIG. 1.

As is illustrated in FIG. 3, the controller 33 is composed of an input unit 25 for receiving a pressure signal Pp from the pilot pressure sensor 34, a storage unit 27 for storing a data map of pressure signals Pp versus current signals Ic to the solenoid-operated proportional valve 32, a computing unit 26 for reading from the storage unit 27 a current signal Ic corresponding to the pressure signal Pp and then outputting the current signal Ic, and an output unit 28 for outputting the current signal Ic to the solenoid-operated proportional valve 32.

Figure 4A:
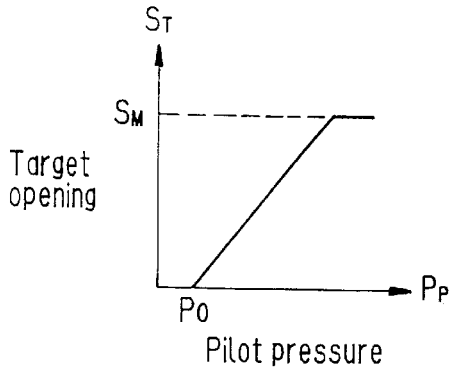
FIG. 4A is a map of pilot pressures Pp from a pilot pressure sensor illustrated in FIG. 1 versus target openings ST of the auxiliary selector valve also shown in FIG. 1.
Figure 4B:
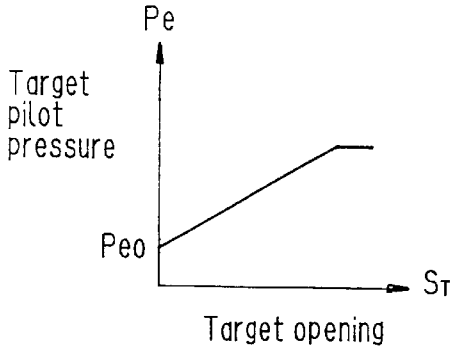
FIG. 4B is a map of target openings ST and target pilot pressures Pe from the solenoid-operated proportional valve.
Figure 4C:
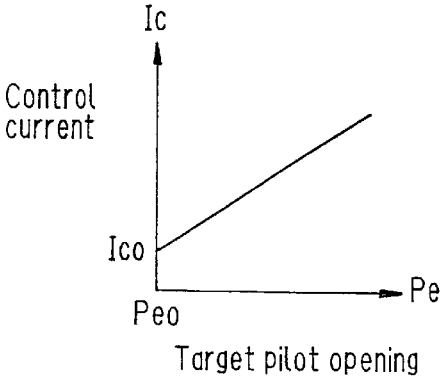
FIG. 4C is a map of target pilot pressures Pe versus control currents Ic to the solenoid-operated proportional valve.

Stored as functions in the storage unit 27 are a map of pilot pressures Pp from the pilot pressure sensor 34 versus target openings ST of the auxiliary selector valve 23 as shown in FIG. 4A, a map of target openings ST and target pilot pressures Pe to be fed from the solenoid-operated proportional valve 32 to the auxiliary selector valve 23 as shown in FIG. 4B, and a map of target pilot pressures Pe fed from the solenoid-operated proportional valve 32 versus current signals Ic to the solenoid-operated proportional valve 32 as shown in FIG. 4C. Incidentally, these functions can be reloaded as desired. When inputted with a pressure signal Pp from the pilot pressure sensor 34, the computing unit 26 reads a current value Ic, which is to be outputted to the solenoid-operated proportional valve 32, corresponding to the pressure signal Pp on the basis of the function stored in the storage unit 27 and outputs the current value Ic to the solenoid-operated proportional valve 32. Accordingly, the controller 33 outputs to the solenoid-operated proportional valve 32 the current signal which corresponds to the pressure signal Pp.

Figure 2:
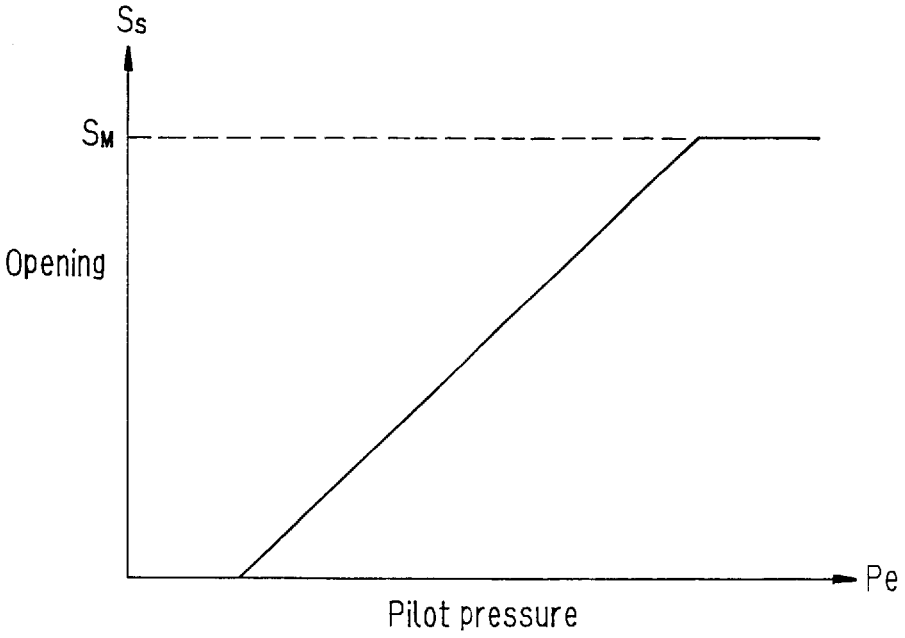
FIG. 2 is a map of pilot pressures from a solenoid-operated proportional valve shown in FIG. 1 versus openings of an auxiliary selector valve also shown in FIG. 1.

Responsive to the current signal Ic from the controller 33, the solenoid-operated proportional valve 32 is operated to feed a pilot pressure Pp to the auxiliary selector valve 23. As is illustrated in FIG. 2, the opening Ss of the auxiliary selector valve 23 gradually becomes greater as the pilot pressure Pe increases. Described specifically, as the pilot pressure Pe which is fed from the solenoid-operated proportional valve 32 increases, the restriction resistance at the auxiliary selector valve 23 decreases. As the opening Ss of the auxiliary selector valve 23 becomes greater, the flow rate of the pressure oil which flows into the by-pass circuit 41 out of the pressure oil delivered from the first hydraulic pump 15 becomes higher. As in the above-described conventional art, the pressure oil which has flowed into the by-pass circuit 41 merges with the pressure oil from the second hydraulic pump 18 through the merging directional control valve 17, and the thus-merged pressure oil is then guided to the hydraulic arm cylinder 12.

As has been described above, excavating work by the hydraulic shovel is performed by combined operation which comprises operation of the arm 11 in the crowding direction and lifting/lowering operation of the boom 13. In this excavating work, a stroke of the boom operating unit 21 is smaller than that of the arm operating unit 22. Accordingly, a movement of the spool of the directional control valve 16 is small but the pilot pressure Pp on the arm-crowding side becomes high. For the reasons mentioned above, the opening of the auxiliary selector valve 23 therefore becomes greater. As a consequence, a major portion of the pressure oil delivered from the first hydraulic pump 15 is branched into the by-pass circuit 41 and through the merging directional control valve 17, merges with the pressure oil fed from the second hydraulic pump 18, and the thus-merged pressure oil is guided to the hydraulic arm cylinder 12. Since the pressure oil fed from the second hydraulic pump 18 and the major portion of the pressure oil delivered from the first hydraulic pump 15 are fed to the hydraulic arm cylinder 12 as described above, the moving speed of the arm 11 becomes faster. Further, because the restriction resistance of the auxiliary selector valve 23 is small, the movement of the spool of the directional control valve 16 is small and, even when the restriction resistance at the directional control valve 16 is high, the pressure oil delivered from the first hydraulic pump 15 is allowed to flow toward the hydraulic arm cylinder 12. An increase in the delivery pressure of the first hydraulic pump 15 is therefore suppressed. In addition, the functions stored in the storage unit 27 of the controller 33 can be reloaded as desired, so that the functions can be adjusted as needed in accordance with variations or the like in the characteristics of the solenoid-operated proportional valve 32 and the auxiliary selector valve 23.

In excavating work by combined operation of operation of the boom 13 and operation of the arm 11 in the crowding direction, the first embodiment therefore makes it possible to feed more pressure oil to the hydraulic arm cylinder 12 so that the moving speed of the arm 11 can be improved. As a consequence, the operability of the work vehicle is improved and further, the working efficiency is also improved. Further still, the restriction resistance at the auxiliary selector valve 23 becomes lower, thereby making it possible to suppress an increase in the delivery pressure of the first hydraulic pump. Hence, wasteful consumption of fuel can be reduced.

Figure 5:
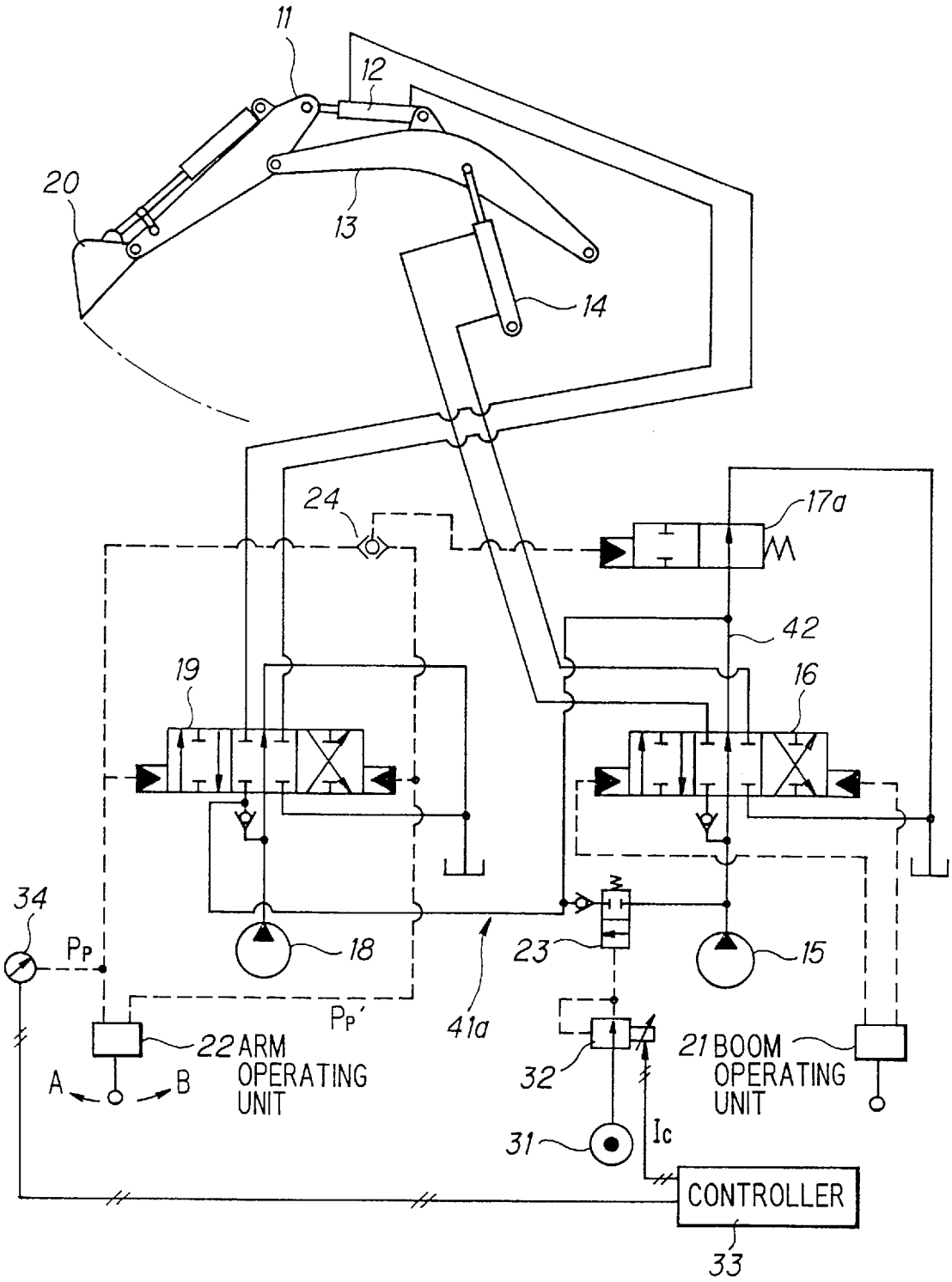
FIG. 5 is a diagram of a hydraulic circuit for a hydraulic shovel, according to a second embodiment of the present invention.

The hydraulic circuit according to the second embodiment of the present invention will next be described with reference to FIG. 5. The hydraulic circuit according to the second embodiment is provided with a high-pressure selector valve 24 for selecting the higher one of the pilot pressures Pp and Pp' fed from the arm operating unit 22 and also with a merging directional control valve 17*a* operable by a pilot pressure from the high-pressure selector valve 24. Further, a by-pass circuit which branches out from an upstream side of a directional control valve 16 for an arm 11 is connected to a pressure-oil-feeding side of the directional control valve 19 for the boom 13. The remaining construction is substantially the same as the above-described hydraulic circuit according to the first embodiment.

In the hydraulic circuit according to the second embodiment constructed as described above, operation of the arm operating unit 22 in a direction A, namely, in an arm-crowing direction causes the auxiliary selector valve 23 to have an opening corresponding to a pilot pressure Pp for similar reasons as in the first embodiment. At the high-pressure selector valve 24, on the other hand, the higher pilot pressure, namely, the arm-crowding-side pilot pressure Pp in this embodiment is selected and is guided as a pilot pressure for the merging directional control valve 17*a*. The merging directional control valve 17*a* is operated by this pilot pressure, thereby cutting off a line which connects the center by-pass line 42 to a tank. As a consequence, the pressure oil from the first hydraulic pump 15 flows to the pressure-oil-feeding side of the directional control valve 19 via the by-pass circuit 41*a*, and merges with the pressure oil delivered from the second hydraulic pump 18. The thus-merged pressure oil is then guided to the hydraulic arm cylinder 12.

In excavating work by combined operation of operation of the boom 13 and operation of the arm 11 in the crowding direction, the second embodiment therefore also makes it possible to feed more pressure oil to the hydraulic arm cylinder 12 so that the moving speed of the arm 11 can be improved. As a consequence, the operability of the work vehicle is improved and further, the working efficiency is also improved. Further still, the restriction resistance at the auxiliary selector valve 23 becomes lower, thereby making it possible to suppress an increase in the delivery pressure of the first hydraulic pump. Hence, wasteful consumption of fuel can be reduced.

Figure 6:
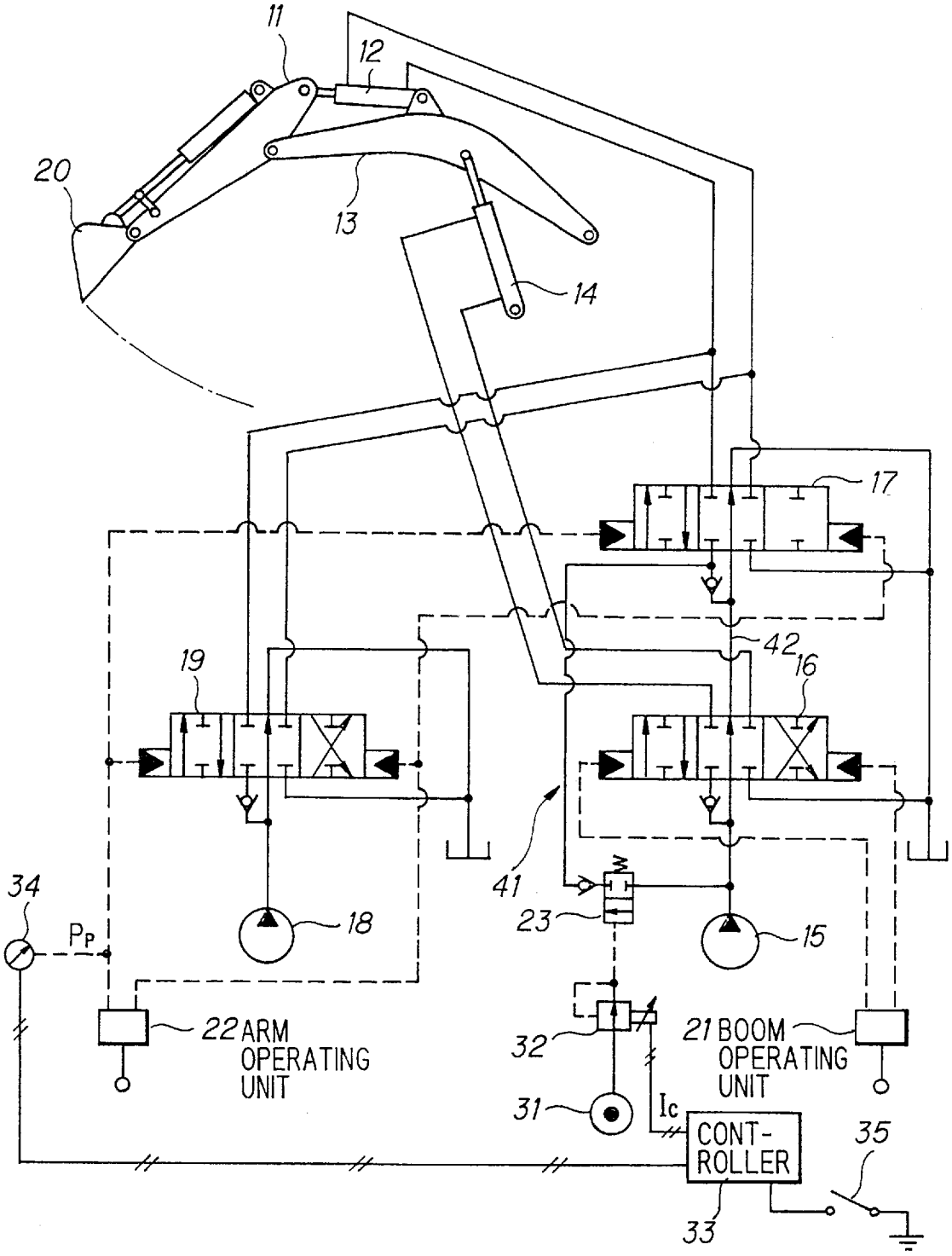
FIG. 6 is a diagram of a hydraulic circuit for a hydraulic shovel, according to a third embodiment of the present invention.
Figure 7:
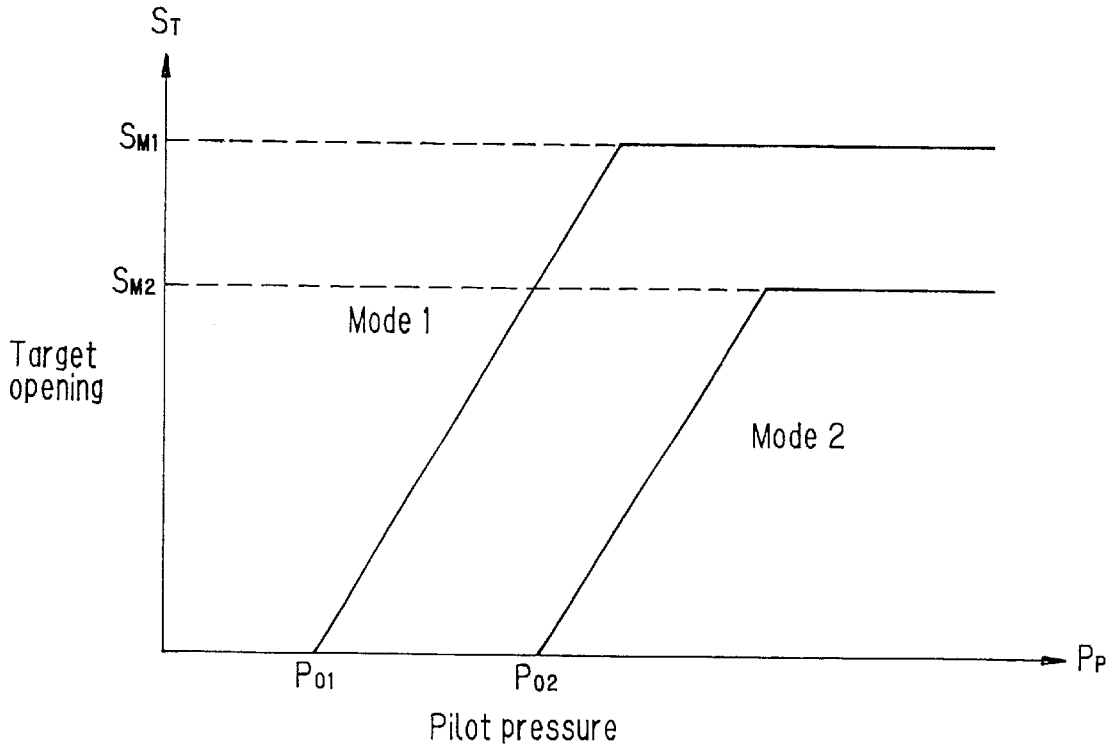
FIG. 7 is a diagram showing characteristic curves selectable by changing over a mode change switch depicted in FIG. 6.

The hydraulic circuit according to the third embodiment of the present invention will now be described with reference to FIG. 6. The hydraulic circuit according to this third embodiment is provided with a mode change switch 35 connected to the controller 33. Stored as functions in the storage unit which forms the controller 33 are two types of data maps of pilot pressures Pp versus target openings of the auxiliary selector valve 23, which correspond to Mode 1 and Mode 2, respectively, as shown in FIG. 7. The remaining construction is the same as in the above-described hydraulic circuit according to the first embodiment illustrated in FIG. 1. Incidentally, of the data maps shown in FIG. 7, the data map corresponding to Mode 1 is the same as that shown in FIG. 4A.

According to the hydraulic circuit of the third embodiment constructed as described above, the mode change switch 35 is operated to output a mode-designating signal corresponding, for example, to Mode 2 when the heavy bucket 20 is mounted. Responsive to the mode-designating signal, the controller 33 then selects the data map for Mode 2 shown in FIG. 7 and reads the target openings ST of the auxiliary selector valve 23 in correspondence to the pilot pressures Pp. In this case, the target opening ST for each pilot pressure Pp is set smaller in the data map for Mode 2 than in the data map for Mode 1. Thus, due to an increase in the restriction resistance at the auxiliary selector valve 23, the flow rate of the pressure oil to be branched to the by-pass circuit 41 becomes lower. In contrast, the flow rate of the pressure oil to be fed to the side of the directional control valve 16 for the boom 13 becomes higher. As a consequence, even when the heavy bucket 20 is mounted and greater load is hence exerted on the hydraulic boom cylinder 14, it is still possible to assure the feeding of as much drive pressure as needed especially upon lifting the boom 13.

In addition to the above-described advantages available from the first embodiment, the third embodiment therefore also makes it possible to assure the feeding of as much drive pressure as needed especially upon lifting the boom 13 because the characteristics of target openings ST of the auxiliary selector valve 23 versus pilot pressures Pp can be selected depending on the load exerted on the hydraulic boom cylinder 14.

The third embodiment is designed to permit changing of the mode between the two modes. It is also possible to permit mode selection among three or more modes.

Further, the auxiliary selector valve 23 is designed to be operable by a pilot pressure Pe from the solenoid-operated proportional valve 32. As an alternative, the hydraulic circuit may also be designed to replace the auxiliary selector valve 23 by a solenoid-operated proportional valve and to operate the solenoid-operated proportional valve by a direct command from the controller 33.

What is claimed is:

1. A hydraulic circuit for a hydraulic shovel, comprising:

at least a first hydraulic pressure source and a second hydraulic pressure source;

a first directional control valve for controlling a flow of pressure oil delivered from said first hydraulic pressure source;

a first hydraulic actuator operable by the pressure oil fed thereto via said first directional control valve;

first operating means for designating operation of said first directional control valve;

a second directional control valve for controlling a flow of pressure oil delivered from said second hydraulic pressure source;

a merging directional control valve arranged on a downstream side of said first directional control valve for causing the pressure oil fed from said first hydraulic pressure source and the pressure oil fed from said second hydraulic pressure source through said second directional control valve to merge with each other;

a second hydraulic actuator operable by the thus-merged pressure oil;

second operating means for designating operation of said second directional control valve and operation of said merging directional control valve;

a by-pass circuit connecting an upstream side of said first directional control valve and an oil-feeding side of said merging directional control valve with each other;

an auxiliary selector valve arranged in said by-pass circuit for being operated by a signal from said second operating means; and detection means for detecting an operated quantity of said second operating means and control means for being inputted with the signal from said detection means and outputting to said auxiliary selector valve a control signal responding to the thus-inputted signal.

2. The hydraulic circuit according to claim 1, wherein said first hydraulic actuator is a hydraulic boom cylinder for driving a boom, and said second hydraulic actuator is a hydraulic arm cylinder for driving an arm.

3. The hydraulic circuit according to claim 1, wherein said control means is provided with storage means for storing beforehand therein a data map of operated quantities of said second operating means versus actuated quantities of said auxiliary selector valve.

4. The hydraulic circuit according to claim 3, wherein said storage means can be updated.

5. The hydraulic circuit according to claim 3, wherein said hydraulic circuit further comprises mode change means connected to said control means, and a plurality of data maps of operated quantities of said second operating means versus actuated quantities of said auxiliary selector means, said data maps corresponding to a like plural number of modes, respectively, are stored in said storage means.

* * * * *